US007040803B2

(12) United States Patent
Hayek et al.

(10) Patent No.: US 7,040,803 B2
(45) Date of Patent: May 9, 2006

(54) DETENT ESCAPEMENT FOR A TIMEPIECE

(75) Inventors: Nicolas Georges Hayek, Meisterschwanden (CH); Thierry Conus, Lengnau (CH); Andrés Cabezas Jurin, Yverdon-les-Bains (CH)

(73) Assignee: Montres Breguet SA, L'Abbaye (CH)

( * ) Notice: Subject to any disclaimer, the term of this patent is extended or adjusted under 35 U.S.C. 154(b) by 0 days.

(21) Appl. No.: 11/000,404

(22) Filed: Dec. 1, 2004

(65) Prior Publication Data

US 2005/0122848 A1 Jun. 9, 2005

(30) Foreign Application Priority Data

Dec. 4, 2003 (EP) ..... 03027929

(51) Int. Cl.
*G04B 15/00* (2006.01)

(52) U.S. Cl. ..... 368/127; 368/131

(58) Field of Classification Search ..... 368/124, 368/127–133

See application file for complete search history.

(56) References Cited

U.S. PATENT DOCUMENTS 48,726 A 7/1865 Rothfelder
474,301 A * 5/1892 Pequegnat ..... 368/131
1,105,062 A * 7/1914 Cochran ..... 368/131
1,359,005 A * 11/1920 Verner ..... 368/132
2,362,836 A * 11/1944 McCullough ..... 368/130
3,462,942 A * 8/1969 Egger et al. ..... 368/132
3,538,705 A * 11/1970 Perry ..... 368/125

FOREIGN PATENT DOCUMENTS

CH 3 299 A 8/1891
CH 64 175 D 1/1977

OTHER PUBLICATIONS

Huguenin, Guye and Gauchat, Echappements et Moteurs pas á pas, 1975, Fig 17-5.
European Search Report, completed Jul. 13, 2004.

* cited by examiner

*Primary Examiner*—Vit W. Miska
(74) *Attorney, Agent, or Firm*—Griffin & Szipl, P.C.

(57) ABSTRACT

The blocking member (6) or detent member of the escapement carries a follower (20) which ends in a beak (21) which cooperates with a small roller (23) comprising a notch (22). When the locking pallet-stone (7) of the blocking member releases itself from the teeth of escapement wheel (2), the beak (21) penetrates in the notch (22). The return of the pallet-stone (7) in the locking position is caused by a rising flank (25) of said notch, said rising flank being inclined such that the beak (21) is forced to follow and climb over said flank when the small roller (23) rotates. The arrangement allows the escapement to resist to shocks and consequently to omit the return spring acting on the blocking member.

5 Claims, 5 Drawing Sheets

DETENT ESCAPEMENT FOR A TIMEPIECE

This application claims priority from European Patent Application 03027929.3 filed Dec. 4, 2003, the entire disclosure of which is incorporated herein by reference.

FIELD OF THE INVENTION

The present invention relates to a detent escapement for a timepiece including an escapement wheel, a balance on the pin of which are fixed a large roller fitted with an impulse pallet-stone and a first actuating finger, a blocking member in the form of a lever hinged on a pin, said blocking member carrying a locking pallet stone, a second actuating finger and a follower which ends in a beak, said escapement further including an elastic member acting on one of the actuating finger to drive the other finger and actuate the blocking member when the roller rotates in a first direction and to move around said other finger without driving the roller when said roller rotates in a second direction opposite to the first, the pin of the balance further carrying a small roller in the circular periphery of which a notch is made and in which the beak of the follower penetrates when the locking pallet-stone releases itself from the escapement wheel.

BACKGROUND OF THE INVENTION

A detent escapement answering the above description has already been proposed and disclosed in the old Swiss Patent No. CH-3299 in the name of Emile James. FIG. 1 of the present description shows a detent-lever pivoted at one of its ends in accordance with a conventional design of this type of escapement.

The balance pin 40 carries a large roller 41, a first small roller 42 having a notch 43 and a second roller 44 carrying an actuating finger 45. The detent-lever 46 is pivoted on a pin 47. It carries a locking pallet-stone 48 a pin 49, a beak 50 and a strip spring 51. The detent-lever 46 is returned to the rest position by a spiral return spring 53.

At the moment when the actuating finger 45 raises the detent-lever 46 with the assistance of the strip spring 51, the beak 50 penetrates the notch 43 at the same time that the escapement wheel 52 moves forward one step. During the additional arc, the beak 50 is released from the notch and is in proximity to the circular periphery 54 of the first small roller 42 in the position shown in the Figure.

This arrangement has the advantage of preventing a tooth of the wheel 52 from leaving the locking pallet stone 48 when the timepiece receives a shock. Indeed, at that moment, the beak 50 abuts for a brief moment against the circular periphery 54 of the first small roller 42, which stops the detent-lever 46 which is immediately returned to the rest position by the spiral return spring 53.

The foregoing identifies a weakness affecting the detent escapement, namely that it is very sensitive to shocks, thus this escapement is reserved especially for chronometers of large dimensions or marine chronometers that are not mechanically stressed, said escapement having the reputation of not being suited to wristwatches. In order to prevent the locking pallet-stone to release itself from the escapement wheel inadvertently, it has already been proposed, in addition to the above-mentioned solution, to fit the blocking member with an additional finger arranged to prevent the rotation of the escapement wheel in the case where such an inadvertent release occurs (see for example the work by Huguenin, Guye and Gauchat, Neuchâtel 1975, FIG. 17-5) entitled "Echappements et Moteurs pas à pas".

Referring again to the afore-cited Swiss Patent, one note however that removal of the beak 50 from the notch 43 is only possible owing to the spiral spring 53, which exerts a return force on the detent-lever 46. Indeed, the notch 43 carries almost radial sheer flanks preventing any removal of the beak which might be caused simply by rotation of the roller itself.

One could thus omit the return spring if one would shape the notch and the beak which penetrates therein in such a way that the return effect of the detent is caused by the rotation itself of the roller. This is one object the present invention.

SUMMARY OF THE INVENTION

For this purpose, the detent escapement according to the invention, in addition to answering the definition of the first paragraph of this description, is characterised in that the return of the pallet-stone in the locking position is caused by a rising flank of said notch, said rising flank being arranged such that the beak climbs over said flank when the small roller rotates in said first direction.

BRIEF DESCRIPTION OF THE DRAWINGS

The invention will be explained in detail hereinafter by one embodiment given by way of example, this embodiment being illustrated by the annexed drawings, in which.

DETAILED DESCRIPTION OF THE INVENTION

Figure 2:
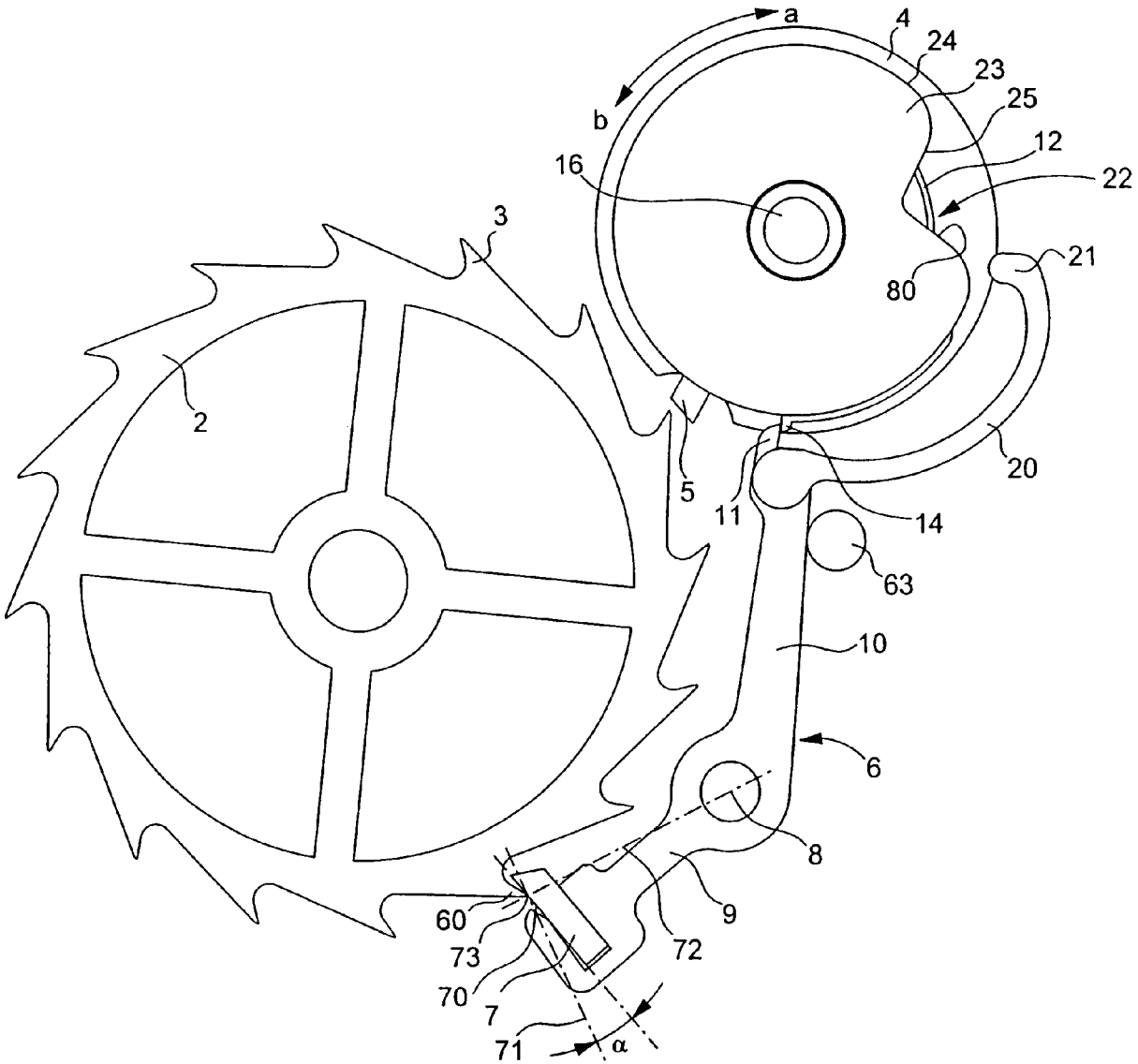
FIG. 2 a plan view of an embodiment of the escapement according to the invention.
Figure 4:
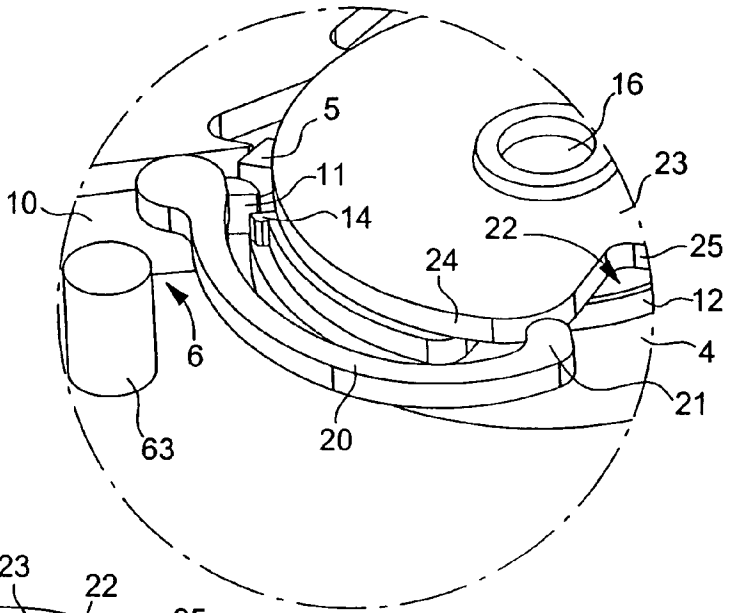
FIG. 4 is an enlargement of zone IV of FIG. 3.
Figure 3:
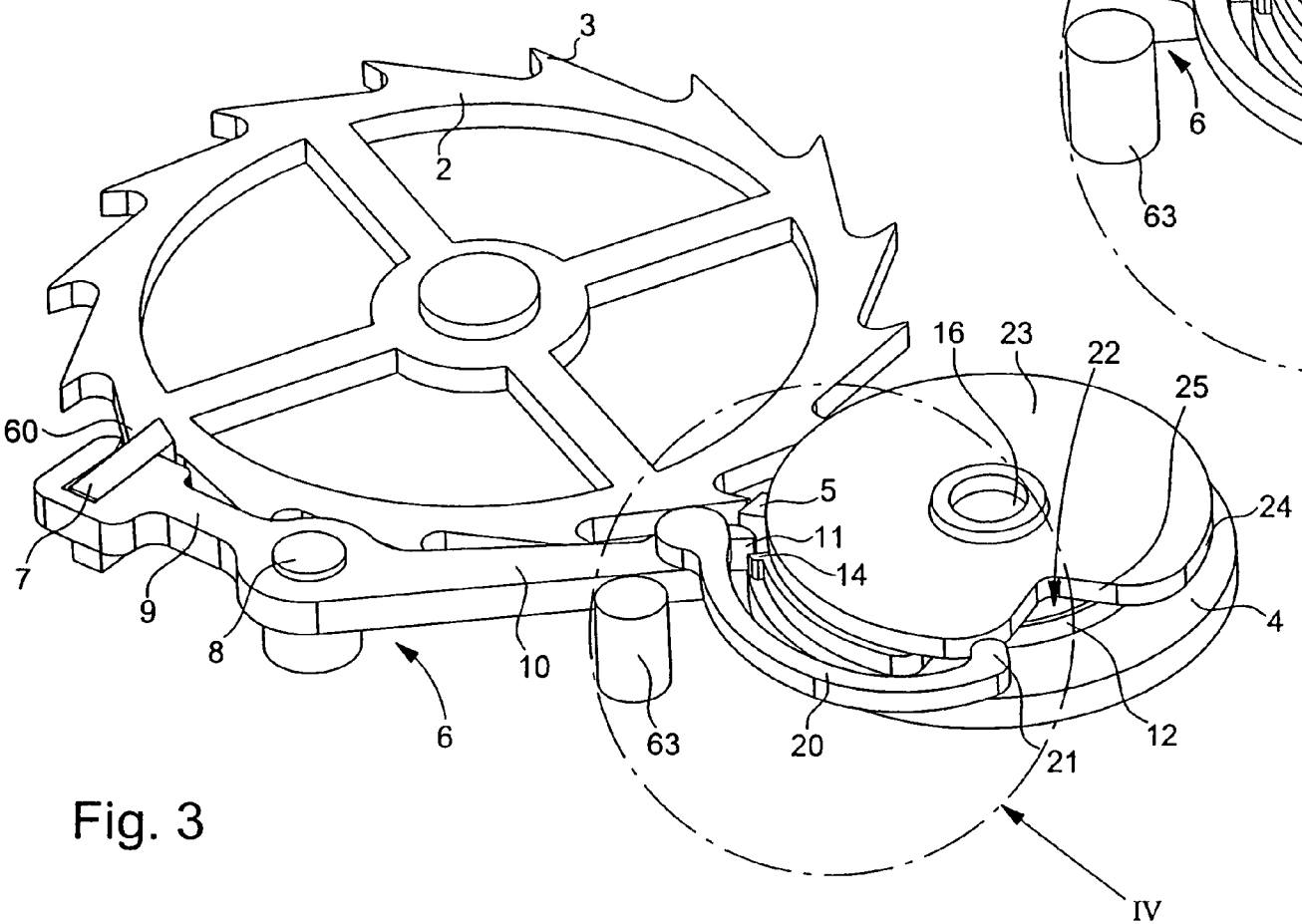
FIG. 3 is a perspective view of the escapement shown in FIG. 2.

FIGS. 2, 3 and 4 illustrate the detent escapement that forms the subject of the present invention. The escapement includes an escapement wheel 2 fitted with teeth 3. Although not shown in the drawings, the escapement wheel is driven by the gear train of the timepiece, which receives its driving force from a barrel. The Figures show a large roller 4 mounted on the pin or arbour 16 of the balance (not shown). The large roller 4 is fitted with a first actuating finger 14 and an impulse pallet stone 5 receiving pulses from teeth 3 of wheel 2. The system also shows a blocking member in the form of a lever 6 hinged on a pin 8. The blocking member 6 carries a locking pallet-stone 7, a second actuating finger 11 and a follower 20 terminated by beak 21. The locking pallet-stone cooperates with teeth 3 of wheel 2. The escapement further includes an elastic member acting on one of the actuating fingers—in the case of FIGS. 2 to 4 on finger 14—to drive the other finger—finger 11 in this case—and actuate blocking member 6 when roller 4 rotates in a first direction a and to move around the other finger—finger 11 here—without driving it when the roller rotates in a second direction b opposite to the first.

Herein lies the principle of all detent escapements in which the impulse is only given to the balance once per oscillation during which the escapement wheel rotates through one angular step, whereas, in the lever escapement, said wheel moves forward one half-step at each alternation.

This is one of the advantages provided by the detent escapement since the energy wasted because of the inertia of the escapement wheel only occurs once per oscillation instead of once per alternation.

FIGS. 2 to 4 further show that the balance arbour or pin 16 carries a small roller 23 in the circular periphery 24 of which there is made a notch 22. As will be shown hereinafter, beak 21 of the follower 20 penetrates notch 22 when locking pallet-stone 7 is released from teeth 3 of escapement wheel 2.

More specifically, FIGS. 2 to 4 show that blocking member 6 includes a first arm 9 which carries locking pallet-stone 7 and a second arm 10 which carries the second actuating finger and follower 20 which ends in beak 21. More specifically also, these same Figures suggest that elastic member 12 acts on first actuating finger 14. The construction illustrated in FIGS. 2 to 4 differs in this from that illustrated in FIG. 1 showing the prior art.

As was stated hereinbefore, the prior art also provides a small roller cooperating with a follower to make the escapement resistant to shocks exerted on the timepiece, but does not omit a spiral spring returning the lever to the rest position. It is an object of the present invention to propose a construction which omits any return spring, taking advantage of the rotation of the roller in order to accomplish such return. In this perspective, the escapement of the present invention is characterised in that the return of locking pallet-stone 7 to the rest position is caused by a rising flank 25 of notch 22 made in the periphery 24 of small plate 23, this flank being slanted such that beak 21 in which follower 20 ends, climbs over said flank 25 when the small roller is rotating in the first direction a.

The embodiment described shows an elastic member 12 located between large and small rollers 4 and 23. This member will not be described in detail here since it can take various forms, its essential role being to act on first finger 14 to drive second finger 11 in one rotational direction a of the rollers and to climb over or move around said finger 11 in the opposite rotational direction b. It will be observed here that the elastic member could be arranged on blocking member 6 and act on finger 11 of said blocking member. In that case, finger 14 would be a finger fixedly implanted on roller 4.

Figure 1:
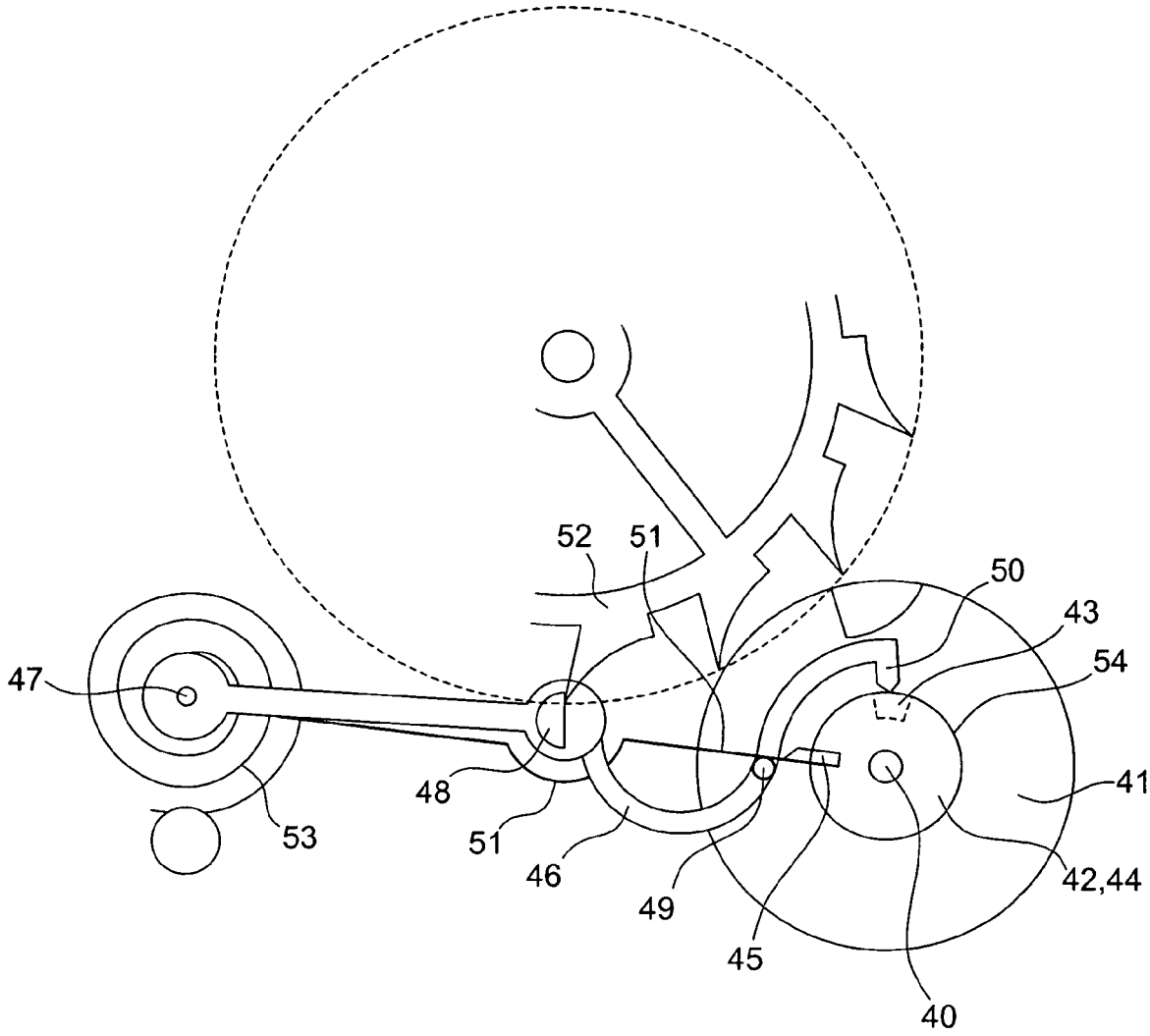
Fig. 1 ( Prior Art )
FIG. 1 shows a detent escapement of the prior art discussed in the preamble portion of the description.

Finally the invention could be applied to the escapement described hereinbefore in the prior art, provided that the first small roller 42 carries a notch 43 with a properly slanted flank, which would enable spiral return spring 53 to be omitted (see FIG. 1).

The operation of the detent escapement will now be described in detail with reference to FIGS. 5 to 11, which illustrate different phases of operation.

Figure 5:
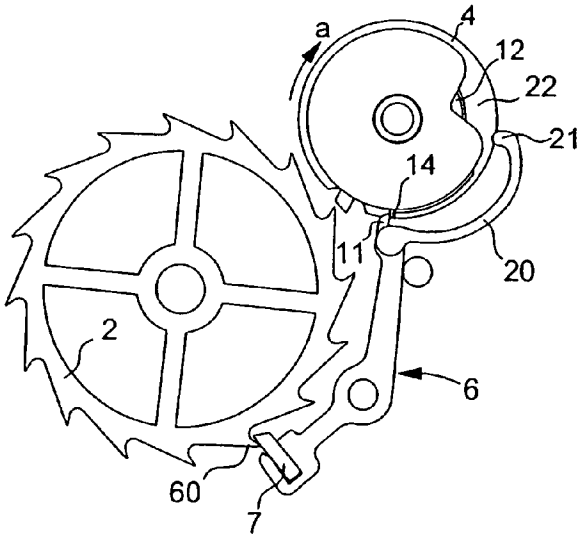

In FIG. 5, roller 4 is rotating in the direction arrow a. Second finger 14 onto which elastic member 12 acts, enters into contact with first finger 11 of blocking member 6. Locking pallet-stone 7 of blocking member 6 is completely engaged in tooth 60 of escapement wheel 2, which is locked. Beak 21 of follower 20 presents itself at the entry of notch 22

Figure 6:
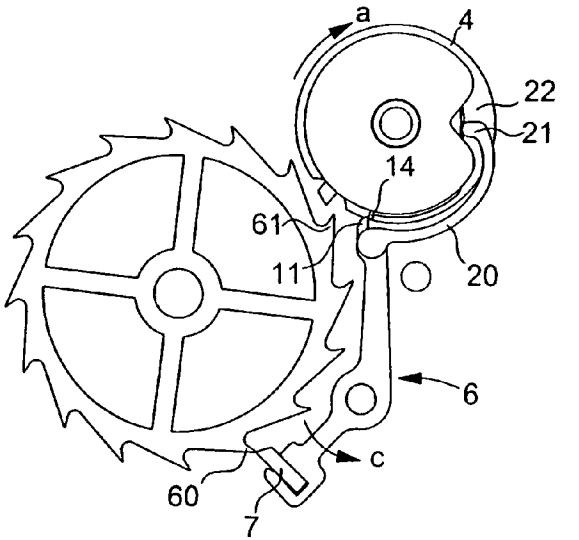
FIGS. 5 to 11 are plan views explaining several operating phases of the escapement of the invention.

In FIG. 6, roller 4 continues its travel in the direction of arrow a. Second finger 14 drives first finger 11 of blocking member 6 and swing it in the direction of arrow c bringing pallet-stone 7 at the very beginning of its release from tooth 60. Beak 21 penetrates into notch 22.

Figure 7:
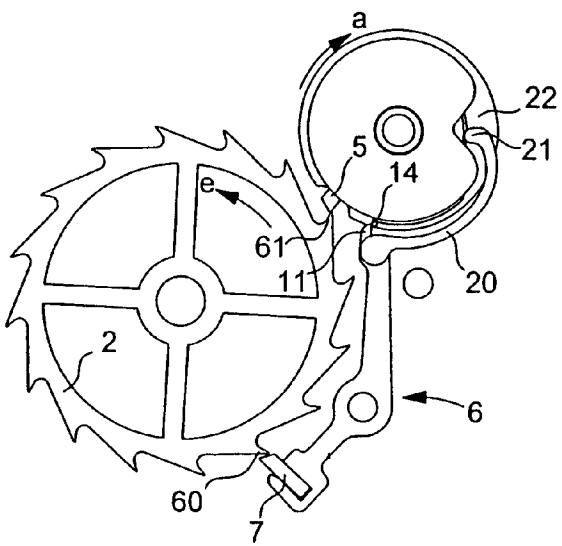

In FIG. 7, escapement wheel 2 is free and rotates in the direction of arrow c. Tooth 61 of wheel 2 enters into contact with impulse pallet-stone 5 of large roller 4, causing a new pulse to be given to said roller which rotates together with the balance fixed thereto, in the direction of arrow e. Second finger 14 is about to be released from first finger 11.

Figure 8:
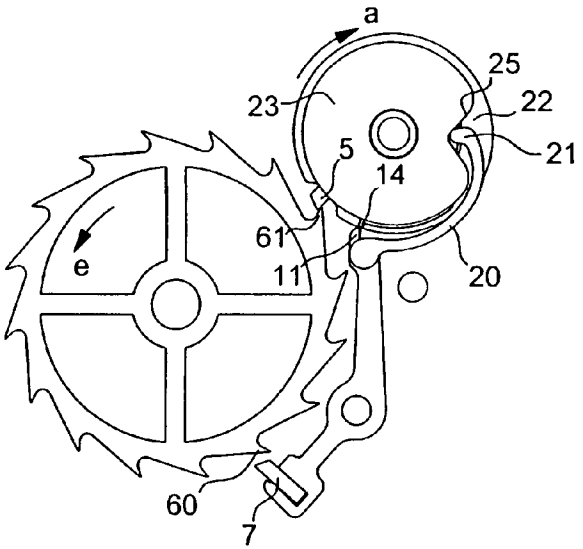

In FIG. 8, the impulse given by tooth 61 to pallet-stone 5 is in progress; second finger 14 has unhooked from first finger 11 driving beak 21 of the follower at the start of flank 25 of notch 22 made in small roller 23.

Figure 9:
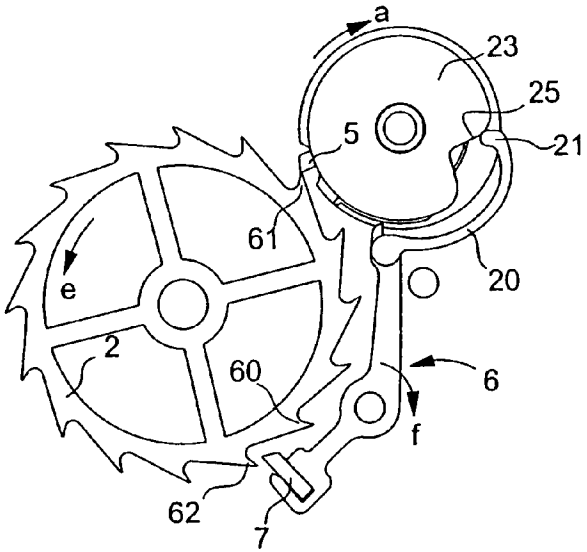

The end of the impulse is shown in FIG. 9. Tooth 61 is about to leave pallet-stone 5. Small roller 23 has been driven by tooth 61 in the direction of arrow a, which has forced beak 21 to climb over flank 25 and forced locking pallet-stone 7 to insert itself in the space separating teeth 60 and 62, blocking member 6 then rotating in the direction of arrow f.

Figure 10:
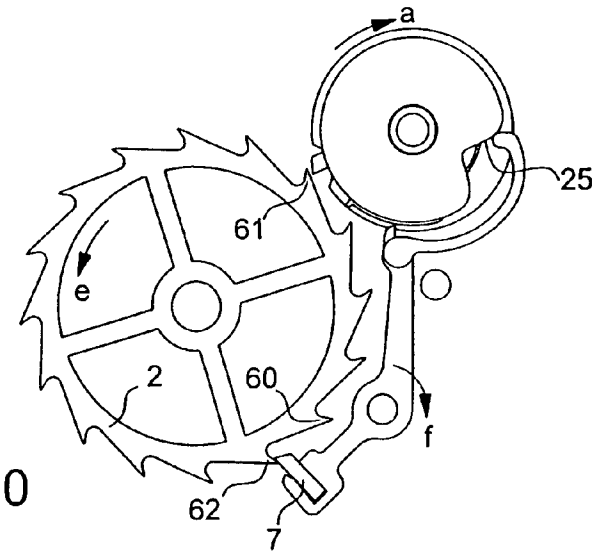
Figure 11:
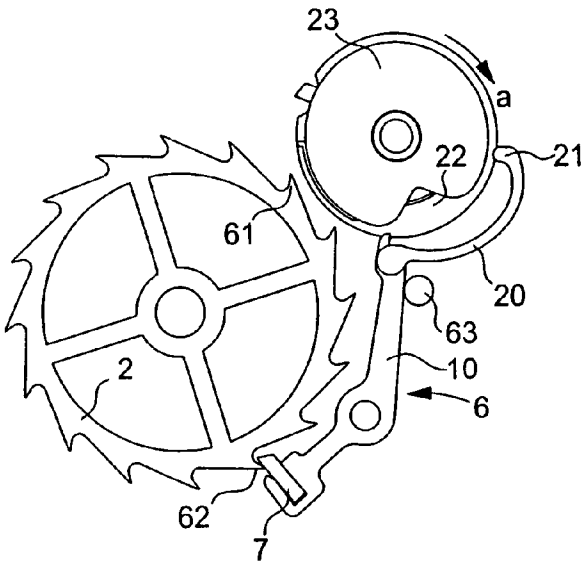

In FIG. 10, tooth 62 has just come into contact with locking pallet-stone 7. The kinetic energy of wheel 2 is then exerted on pallet-stone 7 by tooth 62, which forces pallet-stone 7 to stop at the bottom of tooth 62 and blocking member 6 to abut against a stop pin 63 as shown in FIG. 11. From this moment onward, blocking member 6—more specifically its arm 10—is held against limit stop 63 with a certain force. This is a security device for holding the blocking member while the balance exerts its additional arc of oscillation, a so-called drawing device which opposes resistance to the release of pallet-stone 7 when shocks are applied to the timepiece. The drawing is generally defined by an angle $\alpha$ formed by the locking plane 70 of pallet-stone 7 and a perpendicular line 71 raised on a radius 72 of the blocking member, at the point of contact 73 of tooth 60 and of pallet-stone 7 (see FIG. 2).

FIG. 11 also shows that beak 21 of follower 20 has come out of notch 22. It can be seen that in this situation, beak 21 which is at the end of follower 20, is arranged to be immobile in proximity to the circular periphery 24 of small roller 23 but without touching the latter. Rollers 4 and 23 are then totally free to travel thought their additional oscillation, either one alternation in the direction of arrow a then one alternation in the opposite direction, after which a cycle starts again with the situation shown in FIG. 5.

It will be noted finally that notch 22 has a V-shaped aperture. The entry or trailing flank 80 will have to be shaped so as not to disturb the introduction of beak 21 when locking pallet-stone 7 is released from escapement wheel 2.

Likewise, the exit or rising flank 25 will have to be shaped so as to ensure that at the end of the impulse function, locking pallet-stone 7 is on the trajectory of a tooth of the escapement wheel in order to intercept and then stop it.

The invention claimed is:

1. A detent escapement for a timepiece including:

an escapement wheel;

a pin of a balance on which is fixed a large roller fitted with an impulse pallet stone and a first actuating finger;

a blocking member in the form of a lever hinged on a second pin, said blocking member carrying a locking pallet-stone, a second actuating finger and a follower which ends in a beak; and an elastic member acting on one of the first actuating finger and the second actuating finger to drive the other actuating finger and actuate the blocking member when the roller rotates in a first direction and to move around the other actuating finger without driving the roller when the roller rotates in a second direction opposite to the first direction, the pin of the balance further carrying a small roller in a circular periphery of which is a notch in which the beak of the follower penetrates when the locking pallet-stone releases from the escapement wheel, wherein return of the pallet-stone in a locking position is caused by a rising flank of said notch, said rising flank being slanted such that the beak climbs over said flank when the small roller rotates in the first direction.

2. The escapement according to claim 1, wherein the blocking member further comprises a first arm carrying the locking pallet-stone and a second arm carrying the second actuating finger and the follower terminated by the beak, and the elastic member acts on the first actuating finger.

3. The escapement according to claim 2, wherein the elastic member is disposed between the large roller and the small roller.

4. The escapement according to claim 1, wherein the follower is arranged so that the beak end is immobilized near the circular periphery of the small roller but without touching the circular periphery when the locking pallet-stone is fully engaged in the escapement wheel.

5. The escapement according to claim 2, wherein the follower is arranged so that the beak end is immobilized near the circular periphery of the small roller but without touching the circular periphery when the locking pallet-stone is fully engaged in the escapement wheel.

* * * * *